US007311286B2

(12) United States Patent
Burnett

(10) Patent No.: US 7,311,286 B2
(45) Date of Patent: Dec. 25, 2007

(54) TOILET TISSUE ROLL HOLDER AXLE WITH AUXILARY TISSUE

(76) Inventor: Allen Garrett Burnett, 3184 Rock Creek Dr., Rex, GA (US) 30273-2440

( * ) Notice: Subject to any disclaimer, the term of this patent is extended or adjusted under 35 U.S.C. 154(b) by 391 days.

(21) Appl. No.: 11/182,978

(22) Filed: Jul. 15, 2005

(65) Prior Publication Data

US 2007/0012814 A1 Jan. 18, 2007

(51) Int. Cl.
*B65H 16/06* (2006.01)

(52) U.S. Cl. ..... 242/599; 242/599.1

(58) Field of Classification Search ..... 242/560, 242/599, 599.1, 599.3, 597.5
See application file for complete search history.

(56) References Cited

U.S. PATENT DOCUMENTS 1,136,700 A 4/1915 Moore
2,518,328 A 8/1950 Janonis
2,801,809 A 8/1957 Glaner
5,255,861 A * 10/1993 Lerner ..... 242/598
6,007,019 A 12/1999 Lynch et al.
2002/0020780 A1 2/2002 Otsuji

* cited by examiner

*Primary Examiner*—John Q. Nguyen

(57) ABSTRACT

An axle to hold standard toilet tissue rolls in common spring-held toilet tissue roll holders is provided that contains an auxiliary tissue roll. The axle shaft is constructed of two sliding, interlocking, hollow parts with an external spring compressed therebetween. Each outer end is solid with multiple, protruding, tapered, different size anchor points for mounting. A male part has a protruding key and fits inside a larger diameter female part, which includes a recessed keyway. The key/keyway device prevents the two hollow parts from spinning within each other. A wound auxiliary tissue roll is contained in the axle.

17 Claims, 2 Drawing Sheets

TOILET TISSUE ROLL HOLDER AXLE WITH AUXILARY TISSUE

FIELD OF THE INVENTION

The present invention relates to toilet tissue holders and, more particularly, to an axle containing auxiliary tissue to replace spindles in spring held toilet tissue holders

BACKGROUND OF THE INVENTION

Since the invention of indoor plumbing people have occasionally been stranded on a toilet without toilet tissue because they did not realize there was very little or none at all nearby when they took a seat. Using whatever alternative material was within reach, moving awkwardly around the restroom area searching for toilet tissue, or calling for help were a few of the available remedies.

Fixtures for holding standard toilet tissue rolls vary greatly in every aspect of their design and engineering. There is no standard or average size spindle mounting hole diameter.

Standard toilet tissue roll holders have axle shafts much smaller than the center tube of standard toilet tissue rolls causing wobbling when unrolling.

Devices to house additional standard toilet tissue rolls in the proximity of a toilet can be found in great number.

Small packages of all sorts of tissue types can be found in great number.

The need to solve the problem of running out of toilet tissue while utilizing a toilet is long established. U.S. Pat. No. 2,801,909 filed May 6, 1954 and issued Aug. 6, 1957 to L.O. Glaner addressed the problem.

U.S. Pat No. 5,255,861 issued Oct. 26, 1993 to Saul Lerner also addressed the problem.

Primary, wall mounted holders for the use of standard toilet rolls, and devices for storage of additional standard toilet tissue roll when empty require replenisment of their supply of standard toilet tissue roll or rolls, and have no provision for a smaller auxiliary amount of tissue when inevitably the need for replenishment is overlooked or ignored.

Standard toilet tissue rolls are too large to provide convenient or discreet concealment on a user's person for use under other circumstances in other locations.

Almost all small packages of differing tissue types or of other design types are not the commonly preferred perforated roll format for toilet use, and/or they have no adequate means of protection from the rigors of storage and/or travel.

Camping and other portable-need toilet tissue products are designed for an outdoor application and have no capability to be included conveniently in the indoor restroom environment.

The device in U.S. Pat. No. 2,801,809 to Glaner long ago recognized the best location for an auxiliary tissue supply as being the interior of the center tube of a standard toilet tissue, and more specifically inside the spindle of a holder. But the Glaner device claims cite the device as being a spindle for turning, for turning movement, and rotabably supporting the spindle. There is no provision to establish mounting points anywhere but the center of the axis of the spindle. Glaner is a spindle for use in a specific type and specific size of holder. There is no provision for the device to be a universal replacement in many other types and many other sizes of fixtures. If the Glaner device, or any other spindle is of a size to completely utilize the inside diameter of a toilet tissue roll so to maximize the amount of auxiliary tissue within, then that spindle and an unused toilet tissue roll would not have sufficient clearance to spin in a great number of holders manufactured in recent years. There are no provision to mount the Glaner spindle in a holder with holes smaller than the cylindrical trunnions it cites.

The device in U.S. Pat. No. 5,255,861 to Lerner also recognizes the best location for an auxiliary tissue supply as inside the tube of a toilet tissue roll. But by surrounding a typical small spindle with a supply of toilet tissue to snugly fit in between the spindle and the inner core of the main toilet paper roll, and firmly supporting the toilet paper roll on the spindle, the Lerner device limits itself to only those holders large enough to accommodate an unused toilet tissue roll rotating from its center point. And the auxiliary tissue roll of Lerner with its hollow center would crush easily, and would have no small protective case so it could be stored outside the restroom setting.

SUMMARY OF THE INVENTION

In accordance with the present invention, there is provided an axle to hold a standard toilet tissue roll in the common types of spring-held toilet tissue roll holders, and within that axle in a hollow compartment contain an auxiliary tissue roll. The body of the axle shaft is comprised of two hollow parts, with one part fitting into the other. Each part has a graduated stop allowing a spring to be compressed between them to provide tension. The axle shaft outer diameter is slightly less than the inner diameter of a standard toilet tissue roll center tube allowing the hollow compartment of the axle shaft to provide the maximum space for the auxiliary tissue roll. One end of each axle part is solid and has protruding, tapered anchor points. The inner, or male part has a key along the outer portion where it fits inside the outer, or female part. The female part has a keyway along the interior portion where the male part fits in. The key/keyway device prevents the two hollow parts from spinning one within the other, thereby keeping the anchor points in proper alignment. Auxiliary tissue is tightly rolled and contained in the hollow compartment of the male/female part assembly. When assembled, the male and female parts, the spring, and the auxiliary tissue roll will be compressible to a length slightly longer than a standard toilet tissue roll so the device can be inserted in to and extracted from standard toilet tissue roll holders.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF EMBODIMENTS OF THE INVENTION

Figure 1:
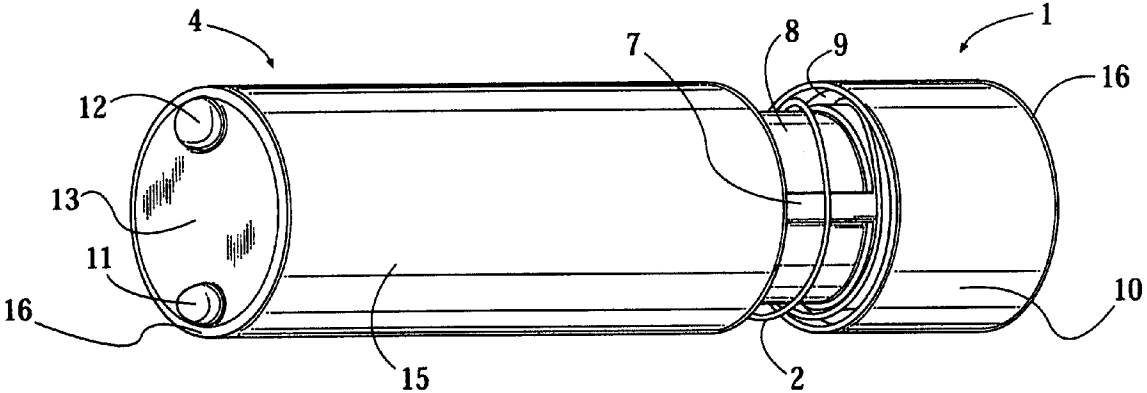
FIG. 1 is a perspective view of a toilet tissue roll holder axle in accordance with the invention.

Ideally, someone discovering an inadequate or depleted supply of standard toilet tissue after beginning use of a toilet at home would like to have access to an auxiliary supply of tissue within an arm's length of that toilet. Where there is a chance away from home that someone might encounter toilet facilities with an inadequate supply of standard toilet tissue, or where there are no indoor plumbing facilities at all, people need an at-hand, discreet and portable method of carrying an intact small amount of tissue with them in case a need should present itself.

The at-home situation and the away-from-home situation both need to be solved by a single entity so a tissue manufacturer can produce a universal tissue product thereby keeping the final cost to the consumer as low as possible. Since standard toilet tissue rolls designed for home use have a universal length and inside diameter, that space should set the standard for an auxiliary tissue size.

The invention is a replacement axle for the most common type of spring-held standard toilet tissue roll holder spindles. The invention has a hollow compartment where an auxiliary tissue roll is stored.

An amount of toilet tissue necessary for only a single user is required when discovery of an inadequate or depleted supply of toilet tissue is made at an inopportune time. The invention provides at least that amount of auxiliary tissue by maximizing the size of the replacement axle relative to the inside diameter of standard toilet tissue rolls.

Because most toilet tissue roll holders have been designed around the common, small diameter spindle, and because toilet tissue roll manufacturers have maximized the size of their product expecting that size spindle to be used, a great many toilet tissue roll holders will not accommodate a toilet tissue roll if it is firmly supported from the center of its diameter. The invention is not a spindle designed to rotate within the holder. The invention is a fixed, unmoving axle designed to hold the toilet tissue roll off center and away from the wall the holder is mounted on, or away from the back of one piece fixtures so an unused standard toilet tissue roll can spin freely. The spring that provides tension to hold the invention in place in standard toilet tissue roll holders is mounted on the exterior of the axle shaft so as not to damage the contents of the hollow compartment.

Therefore the invention has two sets of different sized mounting anchor points protruding from its ends. The minor anchor points fit the smallest holes and taper to also fit differing sizes up to a median diameter. The major anchor points taper so they would fit sizes up to the largest. The invention has a key and keyway device to keep the anchor points aligned.

Away from the standard toilet tissue roll holder, the metal spring removed, and carried in hand, pocket, purse or other means the invention is a protective case with an adequate supply of tissue that provides the user with a discreet and portable solution should the user be forced to utilize a toilet away from their home where an inadequate or depleted supply of toilet tissue might be found, or where toilet facilities are absent, or be forced to utilize a public toilet where the provided toilet tissue supply could have been tampered with, or where the provided toilet tissue supply is inferior in quality to what the user requires.

The auxiliary tissue roll of the invention can be removed and the hollow compartment used instead to store other personal hygiene products or other items sometimes required when utilizing a toilet, and no other close or discreet storage location is available.

The invention is an axle only slightly smaller than the center tube of standard toilet tissue rolls and provides a smooth unrolling action.

The invention is strong enough and durable enough to be stored for quite some time in a great number of places such as automobiles, boats, backpacks or other locations where abuse could be severe, and still provide the user with an intact and adequate supply of tissue should an inopportune moment present itself.

It is therefore an object of the invention to provide an auxiliary tissue roll to those who did not realize there was an inadequate supply of toilet tissue at their disposal before circumstances prevented them from moving about comfortably beyond the immediate area of a toilet they were utilizing.

It is another object of the invention to provide an auxiliary tissue roll and protective case of a size that can be transported on one's person discreetly.

It is another object of the invention to provide a strong and durable holder and an auxiliary tissue supply that can be stored in places where it might encounter abuse.

It is another object of the invention to provide a storage location for personal hygiene supplies or other items in a fixed position within an arm's reach of a toilet.

It is another object of the invention to provide a replacement axle for standard toilet tissue roll holders that will fit in a wide variety of holders.

FIG. 1 is a perspective view of a toilet tissue roll holder axle in accordance with the invention. A male part 1 and a female part 4 are made of plastic, metal, wood or other suitable material. The male part 1 and the female part 4 when assembled establish a protective cover for contents. The male part 1 and the female part 4 when assembled establish a standard toilet tissue roll axle.

The male part 1 and the female part 4 each have a solid end 13. The solid ends have a rounded edge 16 so to be easily inserted into a severe edged center tube of a standard toilet tissue roll. Each solid end 13 mounts anchor points located off-axis from the center-line of the invention. The anchor points are aligned to their twin parts on the opposite solid end 13 of the invention. The off-axis location is required because the outside diameter of the invention is only slightly smaller than the inside diameter of the center tube of standard toilet tissue rolls. Most of the clearance between the axle and the center tube is removed, therefore a majority of unused standard toilet tissue rolls will fit too tightly against the backs of almost all holders and will not spin if the anchor points are placed in the center of the axis.

In this embodiment each solid end 13 supports a tapered minor anchor point 11 and a tapered major anchor point 12 so the invention will fit into a wide variety of standard toilet tissue roll holders. Other embodiments could have anchor points of specific size and/or specific location for particular standard toilet tissue roll holders designed for those embodiments.

An axle knob 10 has a smooth outer surface and is the minor contact surface of the standard tissue roll axle 15 when within a standard toilet tissue roll. During handling, use of the axle knob 10 prevents interference with the action of a metal spring 2. A spring channel 9 is one stop to press against the spring 2 so the spring 2 provides tension axially between the male part 1 and the female part 4 to hold the invention between the brackets or arms of a standard toilet tissue roll holder. A spring axle 8 is a smaller diameter portion of the male part 1 and provides a smooth surface for the spring 2 to flex over. A raised key 7 protrudes along the outer surface of the spring axle 8 shaft beginning at the spring channel 9.

Figure 2:
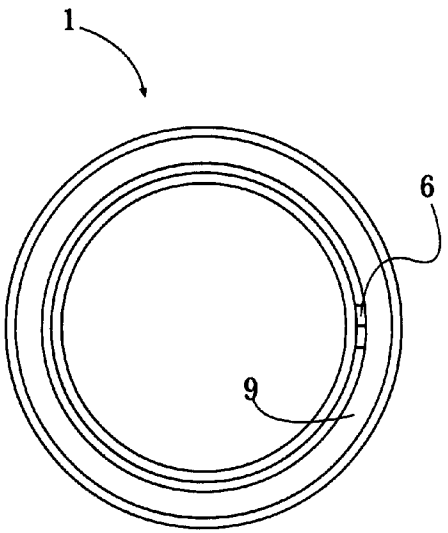
FIG. 2 is an enlarged end view of a hollow end of the male part shown in FIG. 1.

FIG. 2 is an enlarged end view of an open end of the male part 1. This view shows the proportions of the spring channel 9 and a key end 6 to the male part 1.

Figure 3:
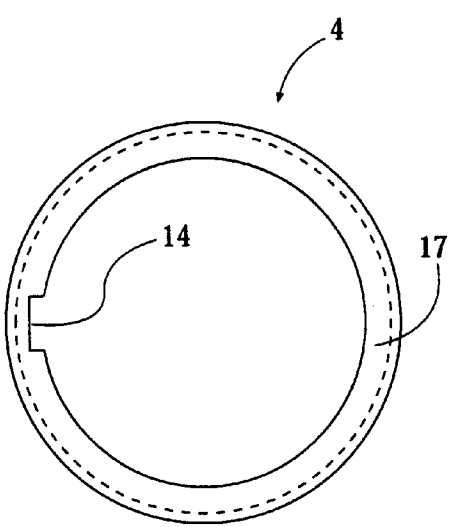
FIG. 3 is an enlarged end view of a hollow end of the female part shown in FIG. 1.

FIG. 3 is an enlarged end view of an open end of the female part 4. This view shows the proportions of a spring ram 17 and a keyway 14 to the female part 4.

Figure 4:
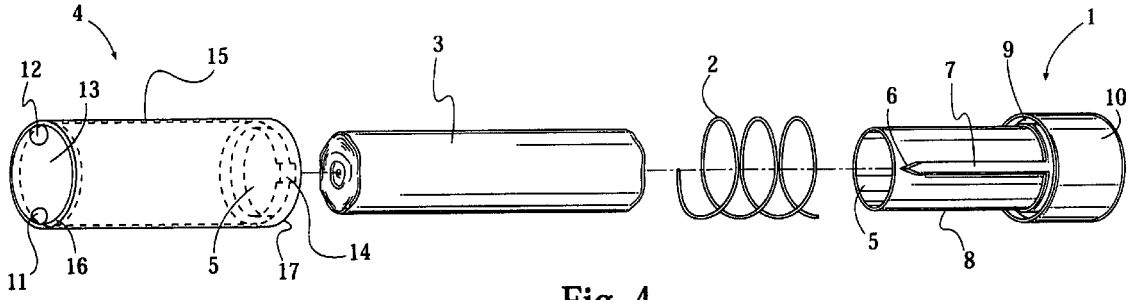
FIG. 4 is an exploded perspective view of a male part, spring, auxiliary tissue roll, and female part of the invention.

FIG. 4 is an exploded perspective, smaller scale view of the invention showing the male part 1, the spring 2, an auxiliary tissue roll 3 and the female part 4. Assembly of the invention would be to place the spring 2 over the spring axle 8, insert the auxiliary tissue roll 3 into a hollow compartment 5 of the male part 1, and then inserting that assembly into a hollow compartment 5 of the female part 4 by aligning the key end 6 with the keyway 14. The smooth outer surface of the female part 4 is the major contact surface of the standard tissue roll axle 15 when within a standard toilet tissue roll.

The last approximate ¼ to ⅓ of a loop of the ends of the spring 2 bends to bring the spring 2 ends parallel to the face of the spring channel 9 and the face of the spring ram 17 to prevent the sharp ends of the spring 2 from gouging the face of the spring channel 9 or the face of the spring ram 17 when flexing.

The auxiliary tissue roll 3 is a solid roll of tightly wound tissue with perforations common to rolled toilet tissue.

The tapered, beveled key end 6 allows easy insertion of the key 7 into the companion keyway 14 of the spring ram 17 when the spring axle 8 end of the male part 1 is inserted into a hollow compartment 5 of the female part 4. The key end 6 is set back from the end of the spring axle 8 so the male part 1 and the female part 4 can be fitted together slightly and then one rotated to align the key 7/keyway 14 device. The key 7/keyway 14 device keeps the off-axis anchor points on the solid ends in alignment.

The spring ram 17 is the stop to press against the spring 2 opposite the spring channel 9. The inner diameter surface of the spring ram 17 provides alignment for the spring axle 8 sufficient to keep the male part 1 and the female part 4 stable when assembled.

Figure 5:
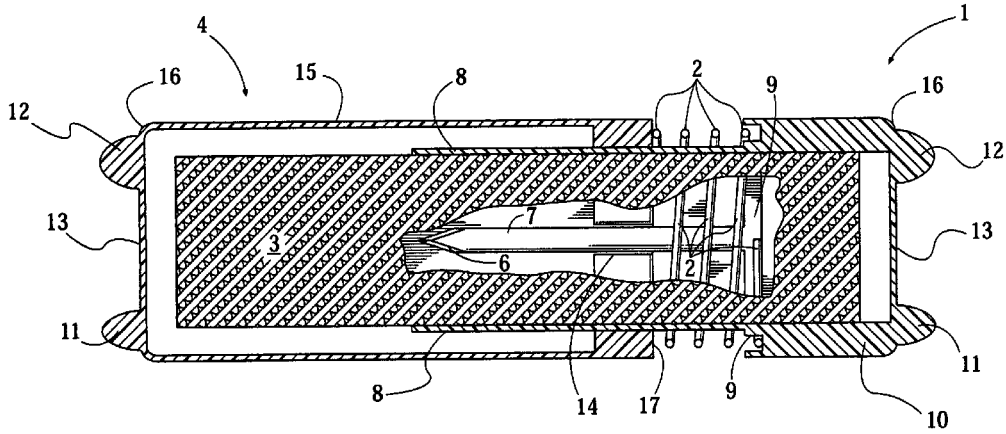
FIG. 5 is an enlarged cross sectional view of a toilet tissue roll holder axle with compartment with auxiliary tissue roll in accordance with the invention.

FIG. 5 is an enlarged cross sectional view of the invention as it would be when installed in a standard toilet tissue roll holder. A gap between the spring channel 9 and the spring ram 17, and a space between the ends of the auxiliary tissue roll 3 and the solid end 13 of the male part 1 and the solid end 13 of the female part 4 allow the device to be compressed further so the invention can be placed in to and taken out of a standard toilet tissue roll holder. Installation would be performed by holding the invention with two fingertips by either opposing pair of anchor points and squeezing the device until the other anchor points could be inserted into the axle holes of a standard toilet tissue roll holder and then releasing the tension on the spring 2 so the device could expand and lock into the axle holes. Extraction by reversing the procedure.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A toilet tissue roll holder axle with auxiliary tissue, comprising:

spare toilet tissue; and means for holding the spare toilet tissue or other items, comprising:

a male part having a keyway and a spring channel;

a female part having means for aligning with the keyway and a spring ram;

means for applying outward tension axially between the male part and the female part;

means, coupled to the female part, for the means for applying outward tension to flex over and for alignment with the spring ram;

means, coupled to the female part, for pressing the means for applying outward tension against the spring channel;

means, coupled to the male part, for pressing against the means for applying outward tension against the spring ram;

means, coupled to the male part, for holding the male part in a hand without interfering with the means for applying outward tension;

means for holding the toilet tissue roll holder axle in a first toilet tissue roll holder with small to median axle holes;

means for holding the toilet tissue roll holder axle in a second toilet tissue roll holder with median to large axle holes;

means for supporting the means for holding the toilet tissue roll holder axle in the first or the second toilet tissue roll holder and for sealing the means for holding the spare toilet tissue;

and means, coupled to the female part, for accommodating a surface of a standard toilet tissue roll.

2. The toilet tissue roll holder axle with auxiliary tissue in accordance with claim 1, wherein said spare toilet tissue comprises a wound, perforated auxiliary tissue roll.

3. The toilet tissue roll holder axle with auxiliary tissue in accordance with claim 1, wherein said means for holding the spare toilet tissue or other items comprises a hollow compartment.

4. The toilet tissue roll holder axle with auxiliary tissue in accordance with claim 1, wherein said means for aligning with the keyway comprises a key.

5. The toilet tissue roll holder axle with auxiliary tissue in accordance with claim 1, wherein said means for the means for applying outward tension to flex over and for alignment with the spring ram comprises a smooth spring axle.

6. The toilet tissue roll holder axle with auxiliary tissue in accordance with claim 1, wherein said means for pressing the means for applying outward tension against the spring ram comprises the spring channel.

7. The toilet tissue roll holder axle with auxiliary tissue in accordance with claim 1, wherein said means for holding the male part in the hand without interfering with the means for applying outward tension comprises an axle knob.

8. The toilet tissue roll holder axle with auxiliary tissue in accordance with claim 1, wherein said means for holding the toilet tissue roll holder axle in the first toilet tissue roll holder with the small to median axle holes comprises a tapered minor anchor point.

9. The toilet tissue roll holder axle with auxiliary tissue in accordance with claim 1, wherein said means for holding the toilet tissue roll holder axle in the second toilet tissue roll holder with the median to large axle holes comprises a tapered major anchor point.

10. The toilet tissue roll holder axle with auxiliary tissue in accordance with claim 1, wherein said means for supporting the means for holding the toilet tissue roll holder axle in the first or the second toilet tissue roll holder and for sealing the means for holding the spare toilet tissue comprises a solid end.

11. The toilet tissue roll holder axle with auxiliary tissue in accordance with claim 1, wherein said means for aligning with the keyway comprises a key.

12. The toilet tissue roll holder axle with auxiliary tissue in accordance with claim 1, wherein said means for accommodating the surface of the standard toilet tissue roll comprises a standard tissue roll axle.

13. The toilet tissue roll holder axle with auxiliary tissue in accordance with claim 1, wherein said means for pressing the means for applying outward tension against the spring channel comprises the spring ram.

14. The toilet tissue roll holder axle with auxiliary tissue in accordance with claim 1, wherein said means for applying outward tension axially between the male part and the female part comprises a metal or other suitable material spring.

15. A toilet tissue roll holder axle with auxiliary tissue, comprising:

a wound auxiliary tissue roll;

a first axle part and a second axle part, biased apart by a spring and defining both a hollow compartment to hold the wound auxiliary tissue roll or other items and a standard tissue roll axle;

a key for aligning the first axle part to the second axle part;

a spring axle coupled to one of the first axle part or the second axle part about which the spring is disposed;

a spring channel coupled to one of the first axle part or the second axle part into which the spring is disposed;

an axle knob for holding one of the first axle part or the second axle part in a hand without interfering with the spring;

a tapered minor anchor point disposed along one of the first axle part or the second axle part for holding the toilet tissue roll holder axle in a first toilet tissue roll holder with small to median axle holes;

a tapered major anchor point disposed along one of the first axle part or the second axle part for holding the toilet tissue roll holder axle in a second toilet tissue roll holder with median to large axle holes;

a flat solid end configured to support the tapered minor anchor point and the tapered major anchor point; and a spring ram coupled to the spring channel.

16. The toilet tissue roll holder axle with auxiliary tissue as recited in claim 15, further comprising: a tapered, beveled key end disposed along the spring channel.

17. The toilet tissue roll holder axle with auxiliary tissue as recited in claim 15, further comprising: a rounded edge, for allowing insertion of the toilet tissue roll holder axle into a center tube of a standard toilet tissue roll.

* * * * *